United States Patent [19]

Wass

[11] Patent Number: 4,549,870

[45] Date of Patent: Oct. 29, 1985

[54] RAFT INFLATION VALVE

[76] Inventor: Lloyd G. Wass, 1670 Blackhawk Cove, Eagan, Minn. 55123

[21] Appl. No.: 525,234

[22] Filed: Aug. 22, 1983

[51] Int. Cl.[4] ..... B63C 9/24

[52] U.S. Cl. ..... 441/41; 441/99; 251/74

[58] Field of Search ..... 441/41, 96, 92, 99; 251/74; 222/3

[56] References Cited

U.S. PATENT DOCUMENTS

| | | | |
|---|---|---|---|
| Re. 28,355 | 3/1975 | Petri | 403/328 |
| 2,796,177 | 6/1957 | Kryzer | 251/74 |
| 3,073,301 | 1/1963 | Hay et al. | 251/74 |
| 3,204,926 | 9/1965 | Wismar | 222/3 |
| 3,260,554 | 7/1966 | Heiland | 251/74 |
| 3,570,805 | 3/1971 | Moran et al. | 251/38 |
| 3,930,517 | 1/1976 | Gagala | 222/3 |
| 4,269,386 | 5/1981 | Crowe | 441/96 |

FOREIGN PATENT DOCUMENTS

| | | | |
|---|---|---|---|
| 559910 | 7/1958 | Canada | 251/74 |
| 920136 | 3/1963 | United Kingdom | 441/41 |

*Primary Examiner*—Trygve M. Blix
*Assistant Examiner*—Thomas J. Brahan
*Attorney, Agent, or Firm*—Kinney & Lange

[57] ABSTRACT

A raft inflation valve includes a valve body having an inlet, an outlet, an internal cylinder open at one end to the valve outlet, an inlet passage leading from the valve inlet to and intersecting with the midsection of the internal cylinder and a firing pin passage which intersects the internal cylinder near its opposite end. A double-ended balanced piston with O-ring seals on both ends is positioned in the internal cylinder so that one end blocks the passage to the outlet. In this position (valve closed) the O-ring seals are on opposite sides of the intersection of the inlet passage which results in a balancing of the gas pressure forces acting on the piston. A compression spring located in the outlet end of the cylinder applies a bias force to the piston. In the valve closed position, movement of the piston away from the spring is physically blocked by a removable firing pin. The valve is actuated by pulling the firing pin out of the firing pin passage. This allows the spring to move the piston away from the outlet end of the internal cylinder so that the piston head partially uncovers the outlet passage. Once the outlet passage is partially uncovered, the gas pressure forces on the piston become unbalanced and the pressure rapidly accelerates the movement of the piston the remaining distance out of the passage, which then allows the inflation gas to flow freely through the valve to the raft.

25 Claims, 4 Drawing Figures

RAFT INFLATION VALVE

REFERENCE TO COPENDING APPLICATION

Reference is hereby made to my copending patent application Ser. No. 484,454, filed Apr. 13, 1983, entitled "Raft Inflation Valve."

BACKGROUND OF THE INVENTION

1. Field of the Invention.

The present invention relates to life raft inflation equipment. In particular, the present invention relates to an improved raft inflation valve which controls the flow of pressurized gas from a pressure vessel to an inflatable life raft.

2. Description of the Prior Art.

Inflatable life rafts have found wide use on ocean-going ships and aircraft. An inflatable life raft offers the advantage of light weight and small size. It is stored in its deflated condition for long periods of time when it is not needed, and yet can be inflated rapidly when it is needed to form a large raft capable of holding relatively large numbers of people.

Inflatable life rafts are inflated using a pressurized inflation gas (such as carbon dioxide, dry air, or nitrogen) which is contained in a pressure tank. When the raft is to be inflated, a valve is actuated by pulling a pull cable which is connected at one end to the valve actuating mechanism in such a manner so as to allow the cable to pull free after the firing mechanism has been actuated. The pull cable is typically connected at its other end to the ship. The pull cable is automatically pulled, therefore, when the raft is thrown overboard or when the ship sinks. The valve opens when actuated to permit the pressurized fluid to expand and fill the life raft.

One highly advantageous raft inflation valve has been the Marada Mark VI valve manufactured and sold by Marada Research and Manufacturing of Chaska, Minn. This valve, two of which are used on the U.S. Navy's 25-man Mark VI raft, is a stainless steel valve with a movable spool. The spool is biased by a spring to maintain the valve in a normally closed position. When the pull cable is pulled, it causes a cam to be rotated, which moves the spool against the spring force to open the valve.

The Marada Mark VI valve has provided very reliable operation at the high pressures, and is capable of being actuated with a relatively low pull force on the pull cable (typically less than 20 pounds). The Marada Mark VI valve, however, because of the intricate design and the relatively large number of high precision parts required, has been expensive to manufacture. In addition, like other raft inflation valves, it has been susceptible to contamination if the source of the inflation gas (in this case dry air) contains dust, dirt particles, or other contaminants.

There has been a continuing need for an improved raft inflation valve which provides ultra-high reliability, has a low actuating force, is not affected by contamination or environmental changes, is easy and relatively inexpensive to manufacture, is relatively light-weight, and is compact. Furthermore, because of a large number of existing problems associated with either marginal valve performance or corrosion related to the improper use of dissimilar metal components (e.g. brass valves and aluminum cylinders) there is a significant need for an improved valve which is capable of retrofitting to existing lift raft inflation systems.

SUMMARY OF THE INVENTION

The present invention is a raft inflation valve which is normally closed, and which is actuated to permit the flow of pressurized gas from a pressure vessel to an inflatable life raft. The raft inflation valve of the present invention includes a valve body, a double-ended balanced piston, and spring bias means for applying a bias force to the piston, and firing means which normally blocks movement of the piston. When the firing means is moved out of engagement with the piston, the spring bias force moves the piston, which causes the valve to open in order to inflate the raft.

The valve body of the valve of the present invention includes an inlet which is connected to the pressure vessel, an outlet which is connected to the inflatable raft, an internal cylinder, and an inlet passage. The internal cylinder is open at a first end to the outlet. The inlet passage extends from the inlet and intersects the internal cylinder.

The double-ended piston has a piston head which is movable in the internal cylinder and which has first and second ends of equal diameter, and a pair of spaced apart O-ring seals carried by the first and second ends of the piston head. In the normally closed condition of the valve, the piston head is positioned so that the O-ring seals are positioned on opposite sides of the inlet passage. The O-ring seals, therefore, block gas flow between the inlet and the outlet.

This results in a balancing of the gas pressure forces acting on the piston, while allowing the piston to be moved (for actuation of the valve) simply by overcoming the O-ring drag on the internal cylinder wall.

The spring bias means provides the bias force to the piston in a direction which urges the piston head toward the second end of the internal cylinder. Movement of the piston head is normally blocked, however, by the firing means.

When the firing means is pulled, it is moved to a position which no longer blocks movement of the piston head. This allows the bias force to move the piston head away from the first end and toward the second end of the cylinder. Once the intersection of the internal cylinder and the inlet passage is partially uncovered, the gas pressure forces become unbalanced. The pressure of the gas accelerates the piston head in its movement away from the outlet once the intersection of the internal cylinder and the inlet passage is partially uncovered.

The firing means is preferably a removable firing pin which extends through a firing pin passage in the valve body and into the internal cylinder. An outer end of the firing pin is connected to a pull cable so that when a pulling force is applied through the cable, the firing pin is pulled out of the firing pin passage and the internal cylinder.

In preferred embodiments of the present invention, the valve body includes an auxiliary passage which intersects the inlet passage at a position between the inlet and the internal cylinder. A fill fitting is attached to the valve body and connects with the auxiliary passage to permit pressurized gas to be supplied to the pressure vessel or removed from the pressure vessel through a flow path which includes the inlet, the inlet passage, the auxiliary passage and the fill fitting. Because all filling or removing of gas from the pressure vessel is provided without having to move the piston and does not use the outlet, the danger of contamination of the piston, the internal cylinder or the outlet during the filling process is avoided.

DETAILED DESCRIPTION OF THE PREFERRED EMBODIMENTS

Figure 1:
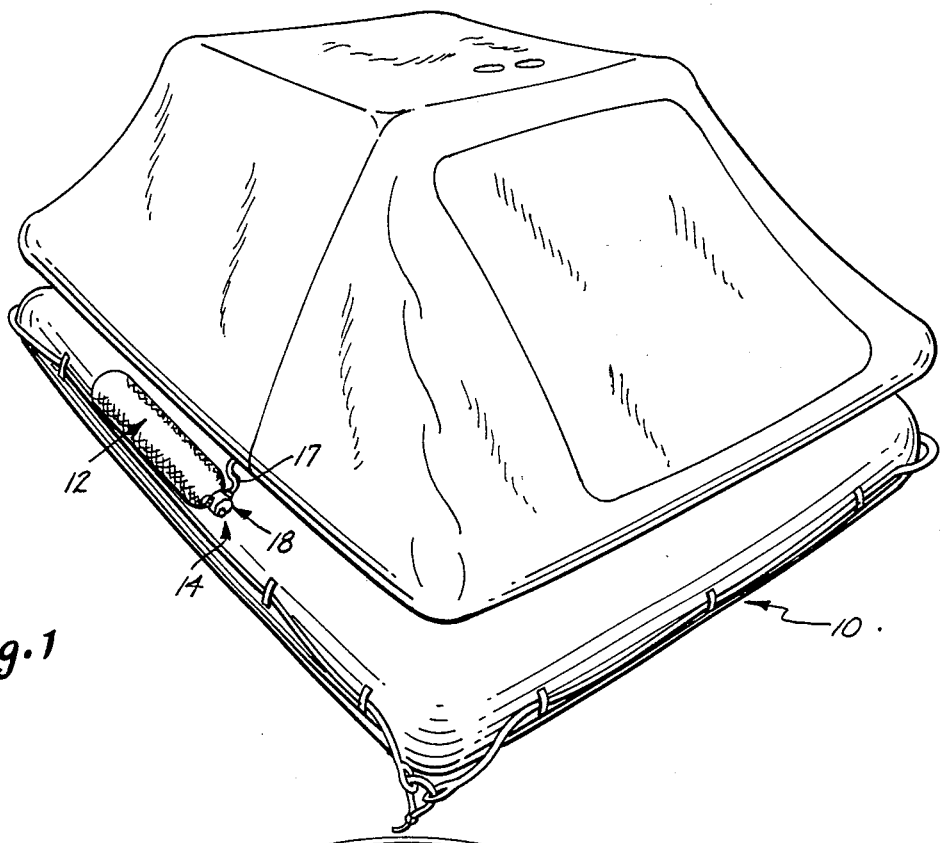
FIG. 1 is a perspective view of an inflatable life raft.

FIG. 1 shows inflatable life raft 10 in its fully inflated condition. The pressurized gas used to inflate life raft 10 has been supplied from one or more pressure vessels 12 which are attached to and carried by raft 10. Pressure vessel or tank 12 is typically a metal or metal-lined fiberglass tank which contains an inflation gas stored under pressure. Each pressure tank 12 has a raft inflation valve 14 attached at one end. Under normal storage conditions, life raft 10 is deflated and stored in a compact package. A pull cable 15, (FIG. 3) is connected to a removable firing pin 16 (FIGS. 2-4) of valve 14 so that when cable 15 is pulled, firing pin 16 is pulled out of valve 14 and valve 14 is actuated. This causes valve 14 to open, thus allowing the inflation gas from pressure tank 12 to pass through valve 14 and outlet hose 17 and into the interior of life raft 10.

Figure 2:
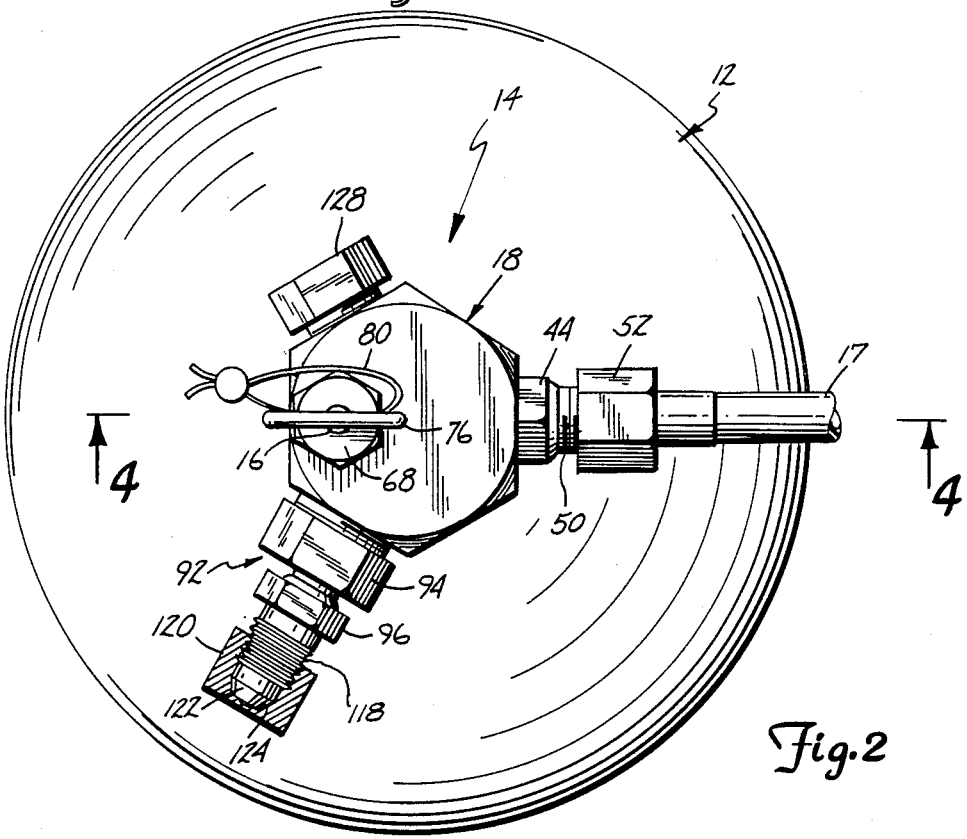
FIG. 2 is an end view, with portions shown in section, of the raft inflation valve of the present invention together with a pressure tank.
Figure 3:
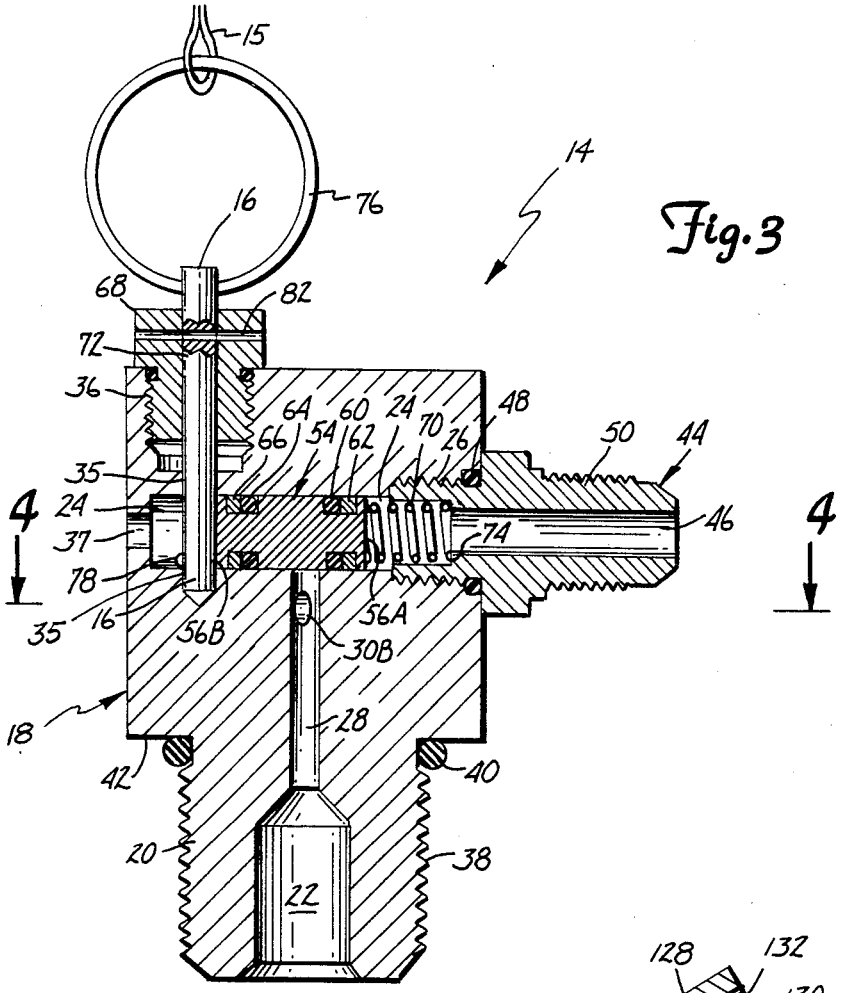
FIG. 3 is a sectional view along section 3—3 of FIG. 2.
Figure 4:
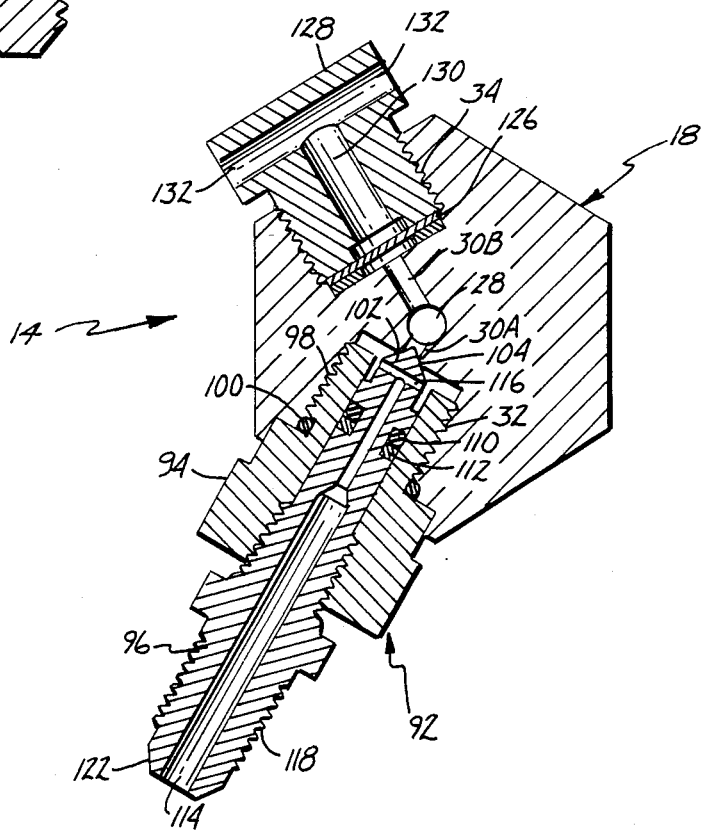
FIG. 4 is a sectional view along section 4—4 of FIG. 3.

FIGS. 2-4 show raft inflation valve 14 of the present invention in further detail. FIG. 2 is an end view of tank 12 and valve 14 with portions shown in section. In FIG. 2, and in the sectional views shown in FIGS. 3 and 4, valve 14 is in its normal closed state prior to actuation. This is the state in which valve 14 is found when life raft 10 is deflated for storage.

Inflation valve 14 includes a hexagonal stainless steel valve body 18 which has a threaded neck portion 20, inlet port 22, internal cylinder 24, outlet port 26, inlet passage 28, auxiliary passage 30A, safety passage 30B, fill port 32, safety relief port 34, firing pin passage 35, threaded pin guide receptacle 36, and vent 37.

Threaded neck portion 20 of valve body 18 connects valve 14 to the end of tank 12. In the embodiment shown in FIG. 3, threaded neck portion 20 has a external (male) threads 38 which mate with internal (female) threads of the port (not shown) in the end of tank 12. O-ring tank seal 40 is positioned against shoulder 42 of valve body 18, and provides a seal between shoulder 42 and tank 12. It should be appreciated that in those embodiments in which valve 14 is to be used with a tank 12 having male rather than female threads, internal (female) threads are provided on the inner surface of inlet port 22.

Inlet port 22 communicates with the interior of tank 12. Inlet passage 28 is connected at one end of inlet port 22, and at its other end it intersects internal cylinder 24. In the preferred embodiments of the present invention, the axis of inlet passage 28 intersects and is perpendicular to the axis of internal cylinder 24.

Outlet fitting 44 is threaded into outlet port 26, so that outlet passage 46 of outlet fitting 44 communicates with one end of internal cylinder 24. O-ring seal 48 provides a seal between outlet fitting 44 and valve body 18. In the embodiment shown in FIGS. 2 and 3, outlet fitting 44 has male threads 50 at its outer end which allow hose coupling 52 (which has cooperating female threads) to be connected to outlet fitting 44.

Control of gas flow from inlet 22 through inlet passage 28 and internal cylinder 24 to outlet passage 46 and hose 17 is controlled by double-ended piston 54. As shown in FIG. 3, piston 54 is a double-ended piston having a first piston head 56A with an O-ring seal 60 and backup ring 62 and second piston head 56B with an O-ring seal 64 and backup ring 66. As shown in FIG. 3, valve 14 is closed, because piston 54 is positioned so that O-rings 60 and 64 are positioned on opposite sides of inlet passage 28 to prevent any leakage in either direction around piston 54. Since there is no pressure difference between the opposite ends of piston 54 (because the ends of piston heads 56A and 56B are of equal diameter), piston 54 can be moved (for actuation) simply by overcoming the drag of O-rings 60 and 64 on the wall of internal cylinder 24. This results in a low actuation force that is only remotely related to the operating pressure of the inflation system.

Valve 14 is actuated to an open condition by a firing mechanism which includes firing pin 16, firing pin guide 68, and compression spring 70. Firing pin guide 68 is threaded into recepticle 36 and has a guide bore 72 which is aligned with firing pin passage 35. As shown in FIG. 3, firing pin 16 is normally inserted through bore 72 and passage 35, so that the inner end of firing pin 16 is positioned in internal cylinder 24 and engages the end of piston head 56B.

The end of piston head 56B is urged into engagement with firing pin 16 by an axial bias force provided by compression spring 70. As shown in FIG. 3, compression spring 70 is carried within an enlarged portion of outlet passage 46 near the outlet end of internal cylinder 24. One end of compression spring 70 acts against internal shoulder 74 of outlet fitting 44 and the other end of compression spring 70 acts against the end of piston head 56A.

Firing pin 16 has a pull ring 76 attached at its outer end for connection to pull cable 15. When a pulling force is applied through cable 15 to pull ring 76, firing pin 16 is pulled out of internal cylinder 24, firing pin passage 35, and guide passage 72. Once firing pin 16 is out of engagement with the end of piston head 56B, compression spring 70 moves piston head 56 away from outlet port 26 and toward vent 37. As soon as the end of piston head 56A clears a portion of the intersection of inlet passage 28 and internal cylinder 24, the pressurized gas begins to flow from pressure vessel 12 through inlet 22 and inlet passage 28 into internal cylinder 24. As O-ring 60 reaches inlet passage 28, the gas pressure force on piston 54 acting in the direction toward outlet port 26 drops, while the gas pressure force on piston 54 acting in the direction toward vent 37 is maintained, and thus the gas pressure forces on piston 54 become unbalanced. This gas pressure force differentual causes rapid acceleration of the movement of piston 54 the remaining distance out of the way of inlet passage 28, which then allows the inflation gas to flow freely from inlet port 22 to outlet port 26. Vent 37 allows air at the opposite end of cylinder 24 to escape, but is small enough to limit the movement of piston 54, so that the force of the pressurized gas does not blow piston 54 entirely out of valve body 18.

Since the gas pressure forces acting on piston 54 are balanced by the double-ended configuration of piston 54 when the O-rings 60 and 64 are positioned on opposite sides of inlet passage 28 (valve closed), the pressure of the gas only affects the bias force required from spring 70 by its effect on O-ring drag. Thus it can be seen that the bias force required to move piston 54 is relatively low, and is in fact only the force required to overcome the drag at O-rings 60 and 64. Compression spring 70 is preferably a relatively stiff spring, so as to provide more than enough bias force to move piston head 56 when firing pin 16 is removed.

In order to prevent accidental or unintended actuation of valve 14 by small forces on cable 15 or pull ring 76, a spring-loaded safety ball catch 78 is carried at the inner end of firing pin 16. Safety ball catch 78 resists the removal of firing pin 16 from internal cylinder 24 unless there is a sufficient pull force on firing pin 16 to depress safety ball catch 78 and allow it to pass into firing pin passage 35.

When valve actuation occurs, pull cable 15 and firing pin 16 must release valve 14, because pull cable 15 is normally attached at its outer end to the ship, and valve 14 is actuated when life raft 10 is thrown overboard or when the ship sinks. In that type of application, cable 15 and firing pin 16 must disconnect entirely from valve 14, so that life raft 10 is totally disconnected from the ship.

In the embodiment shown in FIGS. 2 and 3, firing pin 16 is oriented so that the pull force for actuation is parallel to the longitudinal axis of pressure vessel 12 and valve 14. This "end pull" configuration is particularly advantageous for retrofit applications, because the vast majority of current life raft systems use this configuration.

Safety wire 80 (FIG. 2) is threaded through safety wire passage 82 (FIG. 3), which extends through guide nut 68 and firing pin 16. The outer ends of safety wire 80 are preferably twisted together, as shown in FIG. 2. Safety wire 80 provides a visual indication as to whether valve 14 has already been actuated. Safety wire 80 is broken when a pulling force is applied to firing pin 16 which results in actuation of valve 14.

An important advantage of valve 14 of the present invention is that it permits tank filling, tank bleed down, pressure measurement, and system (i.e. tank and valve) pressure proof testing without disturbance of piston 54 and without exposing internal cylinder 24, piston 54, and outlet fitting 44 to possible contamination that could subsequently result in inflation system failure. As best shown in FIG. 4, auxiliary passage 30A intersects inlet passage 28 between inlet port 22 and internal cylinder 24. Fill fitting assembly 92, which includes housing 94 and fill valve 96, is attached to valve body 18 at fill port 32. Housing 94 has threads 98 which are threaded into fill port 32. O-ring 100 provides a seal between valve body 18 and housing 94.

Fill valve 96 is threaded into housing 94, and has an inner end 102 which engages valve seat 104 of fill port 32. O-ring 110 and backup ring 112 provide a seal between fill valve 96 and housing 94. An internal passage 114 extends substantially the entire length of fill valve 96. Passage 114 ends at inner end 102 of fill valve 96, where it is intersected by passage 116.

At the outer end of fill valve 96 are male threads 118, which permit connection of other apparatus to fill fitting assembly 92 such as a source of gas (when tank 12 is to be filled), a pressure gauge (when the pressure in tank 12 is to be measured), or backup seal/threaded protector cap 120 as shown in FIG. 2 (under normal storage and use conditions).

When tank 12 is being filled or bled down or when pressure measurement or proof testing is being performed through fill fitting 92, fill valve 96 is backed out of housing 94 partially so that valve end 102 is no longer in engagement with valve seat 104. This permits gas flow between passage 114 of fill valve 96 and auxiliary passage 30 in valve body 18. Even when fill valve 96 is partially backed out, O-ring 110 maintains a seal between fill valve 96 and housing 94, so that the gas flow through fill fitting assembly 92 is controlled. To again bring valve end 102 into engagement with valve seat 104, fill valve 96 is rotated in an opposite direction. In any filling operation, the possibility of contamination being introduced exists. Fill assembly 92 minimizes the effects of contamination. First, if a soft contaminant is present at valve seat 104, the force applied as fill valve 96 is threaded inwardly into housing 94 tends to crush and displace the contamination. If a hard contaminant is present at valve seat 104, any leak at valve seat 104 is still minimized. In addition, by placing cap 120 on the outer end of valve 96, passage 114 is still sealed, because flare 122 at the outer end of valve 96 engages seat 124 of cap 120.

Valve 14 also includes a safety relief which prevents an explosion in the event that gas pressure within tank 12 reaches an unsafe level. The safety relief includes frangible disc 126 and disc retainer nut 128. Frangible disc 126 is located in safety port 34 at an outer end of safety passage 30B. At its inner end, safety passage 30B intersects inlet passage 28 at a position between inlet port 22 and internal cylinder 24. Retainer 128 is threaded into safety relief port 34, and holds frangible disc 126 in a position where it seals safety relief port 34. If the pressure within tank 12, and therefore within auxiliary passage 30, exceeds a predetermined level, frangible disc 126 ruptures. This permits inflation gas to flow out of tank 12, through inlet port 22, inlet passage 28 and safety passage 30B, through disc 126 into passage 130 of retainer 128, and out discharge vents 132.

As discussed previously, the valve 14 of the present invention permits proof testing of the inflation system (i.e. tank and valve together) through fill fitting asssembly 92, without damage to valve 14. Because the proof testing involves pressures which are higher than the safety pressure, safety relief port 34 must be blocked so that frangible disc 126 is not ruptured during system proof testing.

The raft inflation valve 14 of the present invention provides a number of significant advantages. First, it provides ultra-high reliability because the portion of valve 14 which controls flow between inlet port 22 and outlet port 26 is not affected by contamination or environmental changes. Tank filling, tank bleed down, pressure measurement, and system proof testing can be performed independently through fill fitting 92.

Second, valve 14 is compact, relatively light-weight, uses a small number of parts and is easier to manufacture than prior art valves.

Third, valve 14 requires a very low actuating force even when the inflation gas is at a high pressure.

Although the present invention has been described with reference to preferred embodiments, workers skilled in the art will recognize that changes may be made in form and detail without departing from the spirit and scope of the invention.

What is claimed is:

1. A normally closed valve which is actuated to permit flow of a pressurized inflation gas from a pressure vessel, the valve comprising:

a valve body having an inlet for connection to the pressure vessel, an outlet, an internal cylinder connected at a first end to the outlet, an inlet passage which extends from the inlet and intersects the internal cylinder at a position intermediate the first end and a second end of the internal cylinder, an auxiliary passage which intersects the inlet passage between the inlet and the internal cylinder, and an auxiliary port connected to the auxiliary passage;

a double-ended piston positioned for axial movement in the internal cylinder, the piston having first and second piston heads with ends of equal diameter, and first and second spaced apart O-ring seals carried by the first and second piston heads, respectively, and positioned on opposite sides of the intersection of the internal cylinder and the inlet passage when the valve is in its normally closed condition to block gas flow to the outlet;

means for controlling gas flow between the auxiliary port and the inlet;

spring bias means for applying a spring bias force to the piston in an axial direction toward the second end of the internal cylinder; and firing means for actuating the valve when pulled, the firing means normally engaging the piston to prevent axial movement of the piston from the normally closed position, and being movable to a position out of engagement with the piston when pulled to permit the spring bias force to move the piston toward the second end of the internal cylinder to uncover the intersection of the internal cylinder and the inlet passage and permit gas flow from the inlet to the outlet.

2. The valve of claim 1 wherein the first piston head has an end surface facing the first end of the internal cylinder the second piston head has an end surface facing the second end of the internal cylinder.

3. The valve of claim 2 and further comprising:

an outlet fitting connected to the valve body at the outlet and having an outlet passage connected to the outlet.

4. The valve of claim 3 wherein the spring bias means comprises a compression spring positioned between the outlet fitting and the end surface of the first piston head.

5. The valve of claim 4 wherein the valve body has a firing pin passage which intersects the internal cylinder adjacent to the second end of the internal cylinder and between the second end and the position at which the inlet passage and the internal cylinder intersect, and wherein the firing means is a firing pin having an inner end which extends through the firing pin passage into the internal cylinder to engage the end surface of the second piston head when the valve is in its normally closed condition and having an outer end which extends out of the valve body.

6. The valve of claim 5 and further comprising:

means attached to the outer end of the firing pin for connecting the firing pin to a pull cable.

7. The valve of claim 5 wherein the inlet passage is essentially perpendicular to the internal cylinder, and wherein the firing pin passage is essentially perpendicular to the internal cylinder and essentially parallel to the inlet passage.

8. The valve of claim 7 wherein the inlet is located at a bottom end of the valve body, wherein the outlet is located in a side of the valve body, and wherein the firing pin passage extends out a top end of the valve body.

9. The valve of claim 8 wherein the valve body has a threaded portion adjacent the inlet for threaded connection of the valve to the pressure vessel.

10. The valve of claim 5 wherein the firing pin includes a spring loaded ball carried by the firing pin in a portion of the inner end which extends into the internal cylinder for preventing removal of the firing pin from the firing pin passage unless a predetermined pull force is applied to the firing pin.

11. The valve of claim 1 wherein the valve body includes a vent extending from the second end of the internal cylinder to an outer surface of the valve body for permitting air to escape from the second end of the internal cylinder when the valve is actuated.

12. The valve of claim 1 wherein the auxiliary port includes a valve seat at an end of the auxiliary passage which is connected to the auxiliary port, and wherein the means for controlling gas flow between the auxiliary port and the inlet comprises:

a housing connected to the auxiliary port and defining a chamber; and an auxiliary valve movable along an axis in the chamber, the auxiliary valve having an inner end and an outer end, a valve passage which extends from a first opening at the outer end to a second opening near the inner end, and an O-ring seal located between the first and second openings to provide a seal between the auxiliary valve and the housing, wherein the auxiliary valve is movable to a closed position in which the inner end of the auxiliary valve engages the valve seat to block gas flow between the auxiliary passage and the valve passage, and wherein the auxiliary valve is movable to an open position in which the inner end of the auxiliary valve is spaced from the valve seat to permit gas flow between the auxiliary passage and the valve passage.

13. The valve of claim 12 wherein the chamber has a female threaded portion and the auxiliary valve has a mating male threaded portion, and wherein movement of the auxiliary valve along the axis is caused by rotation of the auxiliary valve with respect to the housing.

14. The valve of claim 13 wherein the valve body further includes a safety passage which is connected to the inlet passage, and a safety relief port connected to the safety passage, and wherein the raft inflation valve further includes a frangible disc positioned in the safety relief port to block normally the safety passage and for rupturing when pressure in the safety passage exceeds a predetermined level, and disc retaining means for retaining the disc in the safety relief port, the disc retaining means having a relief passage which is connected to the safety passage when the disc ruptures.

15. A raft inflation system comprising:

an inflatable raft;

a pressure vessel for containing pressurized inflation gas for inflating the inflatable raft;

a normally closed raft inflation valve which is actuated to permit flow of the pressurized inflation gas from the pressure vessel to the inflatable raft, the raft inflation valve comprising:

a valve body having an inlet connected to the pressure vessel, an outlet connected to the inflatable raft, an internal cylinder connected at a first end to the outlet, an inlet passage which extends from the inlet and intersects the internal cylinder at a position intermediate the first end and a second end of the internal cylinder, and a firing passage which extends from an outer surface of the valve body and intersects the internal cylinder adjacent the second end and between the second end and the position at which the inlet passage and the internal cylinder intersect;

a double-ended balanced piston positioned for axial movement in the internal cylinder, the piston having first and second ends of essentially equal diameter facing the first and second ends of the internal cylinder, respectively, and including first and second spaced apart O-ring seals carried by the first and second ends of the piston, respectively, and positioned on opposite sides of the intersection of the internal cylinder and the inlet passage when the valve is in its normally closed position;

a compression spring positioned for applying a bias force to the piston in an axial direction toward the second end of the internal cylinder; and firing means having an inner end which extends through the firing passage and into the internal cylinder to engage the piston to prevent axial movement of the piston when the valve is in its normally closed position and having an outer end which extends out of the valve body to receive the pulling force which actuates the valve, the firing pin being movable to a position in which the inner end of the firing means is out of engagement with the piston so as to permit the bias force applied by the compression spring to move the piston toward the second end of the internal cylinder to uncover the intersection of the internal cylinder and the inlet passage and permit gas flow from the inlet to the outlet.

16. A normally closed valve which is actuated by a pulling force to permit flow of a pressurized inflation gas from a pressure vessel, the valve comprising:

a valve body having an inlet for connection to the pressure vessel, an outlet, an internal cylinder connected at a first end to the outlet, an inlet passage which extends from the inlet and intersects the internal cylinder at a position intermediate the first end and a second end of the internal cylinder, and a firing passage which extends from an outer surface of the valve body and intersects the internal cylinder adjacent the second end and between the second end and the position at which the inlet passage and the internal cylinder intersect, an auxiliary passage which intersects the inlet passage between the inlet and the internal cylinder, and an auxiliary port connected to the auxiliary passage;

a double-ended balanced piston positioned for axial movement in the internal cylinder, the piston having first and second ends of essentially equal diameter facing the first and second ends of the internal cylinder, respectively, and including first and second spaced apart O-ring seals carried by the first and second ends of the piston, respectively, and positioned on opposite sides of the intersection of the internal cylinder and the inlet passage when the valve is in its normally closed position to block gas flow to the outlet;

a compression spring positioned for applying a bias force to the piston in an axial direction toward the second end of the internal cylinder;

firing means having an inner end which extends through the firing passage and into the internal cylinder to engage the piston to prevent axial movement of the piston when the valve is in its normally closed position and having an outer end which extends out of the valve body to receive the pulling force which actuates the valve, the firing pin being movable to a position in which the inner end of the firing means is out of engagement with the piston so as to permit the bias force applied by the compression spring to move the piston toward the second end of the internal cylinder to uncover the intersection of the internal cylinder and the inlet passage and permit gas flow from the inlet to the outlet; and means for controlling gas flow between the auxiliary port and the inlet.

17. The valve of claim 16 and further comprising:

means attached to the outer end of the firing pin for connecting the firing pin to a pull cable.

18. The valve of claim 16 wherein the inlet passage is essentiallly perpendicular to the internal cylinder, and wherein the firing pin passage is essentially perpendicular to the internal cylinder and essentially parallel to the inlet passage.

19. The valve of claim 18 wherein the inlet is located at a bottom end of the valve body, wherein the outlet is located in a side of the valve body, and wherein the firing pin passage extends out a top end of the valve body.

20. The valve of claim 16 wherein the firing pin includes a spring loaded ball carried by the firing pin in a portion of the inner end which extends into the internal cylinder for preventing removal of the firing pin from the firing pin passage unless a predetermined pull force is applied to the firing pin.

21. The valve of claim 16 wherein the valve body includes a vent extending from the second end of the internal cylinder to an outer surface of the valve body for permitting air to escape from the second end of the internal cylinder when the valve is actuated.

22. The valve of claim 16 wherein the auxiliary port includes a valve seat at an end of the auxiliary passage which is connected to the auxiliary port, and wherein the means for controlling gas flow between the auxiliary port and the inlet comprises:

a housing connected to the auxiliary port and defining a chamber; and an auxiliary valve movable along an axis in the chamber, the auxiliary valve having an inner end and outer end, a valve passage which extends from a first opening at the outer end to a second opening near the inner end, and an O-ring seal located between the first and second openings to provide a seal between the auxiliary valve and the housing, wherein the auxiliary valve is movable to a closed position in which the inner end of the auxiliary valve engages the valve seat to block gas flow between the auxiliary passage and the valve passage, and wherein the auxiliary valve is movable to an open position in which the inner end of the auxiliary valve is spaced from the valve seat to permit gas flow between the auxiliary passage and the valve passage.

23. The valve of claim 22 wherein the chamber has a female threaded portion and the auxiliary valve has a mating male threaded portion, and wherein movement of the auxiliary valve along the axis is caused by rotation of the auxiliary valve with respect to the housing.

24. The valve of claim 23 wherein the valve body further includes a safety passage which is connected to the inlet passage, and a safety relief port connected to the safety passage, and wherein the valve further includes a frangible disc positioned in the safety relief port to block normally the safety passage and for rupturing when pressure in the safety passage exceeds a predetermined level, and disc retaining means for retaining the disc in the safety relief port, the disc retaining means having a relief passage which is connected to the safety passage when the disc ruptures.

25. A raft inflation system comprising:

an inflatable raft;

a pressure vessel for containing pressurized inflation gas for inflating the inflatable raft;

a normally closed raft inflation valve which is actuated to permit flow of the pressurized inflation gas from the pressure vessel to the inflatable raft, the raft inflation valve comprising:

a valve body having an inlet connected to the pressure vessel, and outlet connected to the inflatable raft, an internal cylinder connected at a first end to the outlet, and an inlet passage which extends from the inlet and intersects the internal cylinder at a position intermediate the first end and a second end of the internal cylinder;

a double ended piston positioned for axial movement in the internal cylinder, the piston having first and second piston heads with ends of equal diameter, the first and second spaced apart O-ring seals carried by the first and second piston heads, respectively, and positioned on opposite sides of the intersection of the internal cylinder and the inlet passage when the valve is in its normally closed condition;

spring bias means for applying a spring bias force to the piston in an axial direction toward the second end of the internal cylinder; and firing means for actuating the valve when pulled, the firing means normally engaging the piston to prevent axial movement of the piston from the normally closed position, and being movable to position out of engagement with the piston when pulled to permit the spring bias force to move the piston toward the second end of the internal cylinder to uncover the intersection of the internal cylinder and the inlet passage and to permit gas flow from the inlet to the outlet to cause inflation of the raft.

* * * * *